US008567638B2

(12) United States Patent
Bandoh et al.

(10) Patent No.: US 8,567,638 B2
(45) Date of Patent: Oct. 29, 2013

(54) OPENABLE AND CLOSABLE CONTAINER

(75) Inventors: Takeshi Bandoh, Kanonji (JP); Takahiro Ueda, Kanonji (JP); Ikue Hiramatsu, Kurashiki (JP); Masaho Hayashi, Tokyo (JP); Hiroshi Uematsu, Tokyo (JP); Toshihiko Uenishi, Tokyo (JP); Norio Ochi, Tokyo (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 13/129,450

(22) PCT Filed: Oct. 29, 2009

(86) PCT No.: PCT/JP2009/068596

§ 371 (c)(1),
(2), (4) Date: Sep. 8, 2011

(87) PCT Pub. No.: WO2010/055780

PCT Pub. Date: May 20, 2010

(65) Prior Publication Data

US 2011/0309099 A1 Dec. 22, 2011

(30) Foreign Application Priority Data

Nov. 14, 2008 (JP) ..... 2008-292563

(51) Int. Cl.
*B65D 53/00* (2006.01)
*B65D 73/00* (2006.01)

(52) U.S. Cl.
USPC ..... 220/849; 206/233; 206/494; 206/812

(58) Field of Classification Search
USPC ..... 220/849, 232, 295; 206/233, 494, 812, 206/438
See application file for complete search history.

(56) References Cited

U.S. PATENT DOCUMENTS 5,699,912 A * 12/1997 Ishikawa et al. ..... 206/494
6,065,626 A * 5/2000 Huang et al. ..... 220/254.5
6,206,221 B1 * 3/2001 Bando et al. ..... 220/254.5
6,364,101 B1 * 4/2002 Schultz ..... 206/210

(Continued)

FOREIGN PATENT DOCUMENTS

EP 1 939 104 A1 7/2008
JP 08-080960 3/1996

(Continued)

OTHER PUBLICATIONS

European extended search report based on corresponding EP application No. 09826030.0 dated May 7, 2012, (5 pgs).

(Continued)

*Primary Examiner* — Anthony Stashick
*Assistant Examiner* — Robert Stodola
(74) *Attorney, Agent, or Firm* — Brinks Hofer Gilson & Lione

(57) ABSTRACT

An openable and closable container includes a container body having a take-out opening, and an opening-closing lid provided on the container body swingably about a swing axis on a base end side of the lid, the lid opening and closing the take-out opening. Plate rubber (an elastic member) is provided between the contain body and the opening-closing lid. A packing member (an elastic sealing body) is attached to the rear surface of the opening-closing lid such that the packing member seals the take-out opening of the upper plate.

4 Claims, 9 Drawing Sheets

(56) References Cited

U.S. PATENT DOCUMENTS

| | | | | |
|---|---|---|---|---|
| 6,394,298 | B1 | 5/2002 | Zaidman | |
| 6,554,156 | B1 * | 4/2003 | Chong | 221/63 |
| 6,655,544 | B1 * | 12/2003 | Tanaka et al. | 220/835 |
| 7,213,720 | B2 * | 5/2007 | Giraud | 220/839 |
| 2004/0173612 | A1 | 9/2004 | Giraud | |
| 2005/0067313 | A1 * | 3/2005 | Banik et al. | 206/494 |
| 2005/0258174 | A1 * | 11/2005 | Giraud | 220/4.21 |
| 2006/0096984 | A1 * | 5/2006 | Bandoh et al. | 220/254.5 |

FOREIGN PATENT DOCUMENTS

| | | | | |
|---|---|---|---|---|
| JP | 2000-142842 | | | 5/2000 |
| JP | 2004-299768 | | | 10/2004 |
| JP | 2004-502062 | A | | 10/2004 |
| JP | 2006-502062 | A | | 1/2006 |
| JP | 2007204095 | A | * | 8/2007 |
| JP | 2008-100749 | | | 5/2008 |
| WO | WO 99/29581 | | | 6/1999 |
| WO | WO 2004/033339 | A1 | | 4/2004 |

OTHER PUBLICATIONS

International Patentability Report and Written Opinion based on corresponding PCT application No. PCT/JP2009/068596 dated Jun. 30, 2011, (6 pgs).

International Search Report based on corresponding PCT application No. PCT/JP2009/068596 dated Feb. 2, 2010, 4 pgs.

Chinese Office Action based on corresponding CN application No. 200901452770 dated Jul. 20, 2012, and English translation (6 pgs).

* cited by examiner (a)

(b)

OPENABLE AND CLOSABLE CONTAINER

RELATED APPLICATION

This application is a 35 U.S.C. §371 national phase filing of International Patent Application No. PCT/JP2009/068596, filed Oct. 29, 2009, through which and to which priority is claimed under 35 U.S.C. §119 to Japanese Patent Application No. 2008-292563, filed Nov. 14, 2008.

TECHNICAL FIELD

The present invention relates to an openable and closable container including, for example, a main body having a take-out opening, and an opening-closing lid openable and closable with respect to the main body. In particular, the invention relates to an openable and closable container having enhanced sealing performance of a container body with an opening-closing lid.

BACKGROUND ART

In general, an openable and closable container for storing wet tissue paper or the like therein includes a container body and an opening-closing lid. The container body stores therein wet tissue paper or the like and has a take-out opening for taking out the wet tissue or the like. The opening-closing lid seals the take-out opening in an openable and closable manner.

To use wet tissue paper or the like, the opening-closing lid is opened with respect to the take-out opening of the container body and the wet tissue paper or the like is taken out one by one from the take-out opening of the container body.

PRIOR-ART DOCUMENT

Patent Document

Patent Document 1: JP-A-2003-170950

As described above, the conventional openable and closable container includes the container body and the opening-closing lid swingably attached to the container body. When wet tissue paper or the like is not taken out for use, the opening-closing lid is closed to prevent the vaporization of a liquid component which is contained in the wet tissue paper stored in the container body.

Incidentally, as described in e.g. JP-A-2003-170950, when the opening-closing lid is closed with respect to the container body, a closing rib of the opening-closing lid is fitted into a recessed portion of the container body and thereby the opening-closing lid is adapted to seal the take-out opening of the container body.

However, the opening and closing container configured described above provides a slight gap between the container body and the opening-closing lid. As a result, the liquid component of the wet tissue paper may vaporize after a lapse of a long time.

DISCLOSURE OF INVENTION

The present invention has been made in view of such drawbacks and aims to provide an openable and closable container that has enhanced sealing performance of a container body with an opening-closing lid and that can prevent the vaporization of a liquid component of a wet tissue paper.

The present invention is an openable and closable container comprising: a main body having a take-out opening; an opening-closing lid provided on the main body swingably about a swing axis on a base end side of the lid, the opening-closing lid opening and closing the take-out opening; and an elastic member provided between the main body and the opening-closing lid; wherein an elastic sealing body is attached to a rear surface of the opening-closing lid such that the elastic sealing body seals the take-out opening of the main body.

The present invention is an openable and closable container characterized in that the main body includes an upper plate and the take-out opening is formed in the upper plate.

The present invention is an openable and closable container characterized in that a frame body is formed on a rear surface of the opening-closing lid and the elastic sealing body is composed of a packing member attached to the inside of the frame body.

The present invention is an openable and closable container characterized in that: the packing member includes: a packing central portion, a packing outer circumferential portion provided on an outer circumference of the packing central portion and elastically vertically movable with respect to the packing central portion, and a close-contact portion provided at a downward portion of the packing outer circumferential portion, and when the opening-closing lid is closed, the close-contact portion comes into close contact with a circumference of the take-out opening of the main body.

The present invention is an openable and closable container characterized in that an annular rib is formed on the upper plate of the main body to surround the take-out opening, and when the opening-closing lid is closed, the close-contact portion comes into close contact with the annular rib.

The present invention is an openable and closable container characterized in that the main body is composed of a container body, and wet tissue paper impregnated with alcohol is stored inside of the container body.

According to the present invention, the elastic sealing body attached to the rear surface of the opening-closing lid seals the take-out opening of the main body. Therefore, the contain body can reliably be sealed with the opening-closing lid so that vaporization of a liquid component of the wet tissue paper can be prevented.

MODE FOR CARRYING OUT THE INVENTION

One embodiment of the present invention will hereinafter be described with reference to the drawings. FIGS. 1 to 15 illustrate the embodiment of the present invention.

The entire configuration of a wet tissue paper storing container (an openable and closable container) is described with reference to FIGS. 1 to 6. As illustrated in FIGS. 1 to 6, the openable and closable container 10 includes a downside opening container body (a main body) 11 storing e.g. wet tissue paper 41 as contents therein, and a bottom lid 12 sealing the downside opening of the container body 11.

Figure 1:
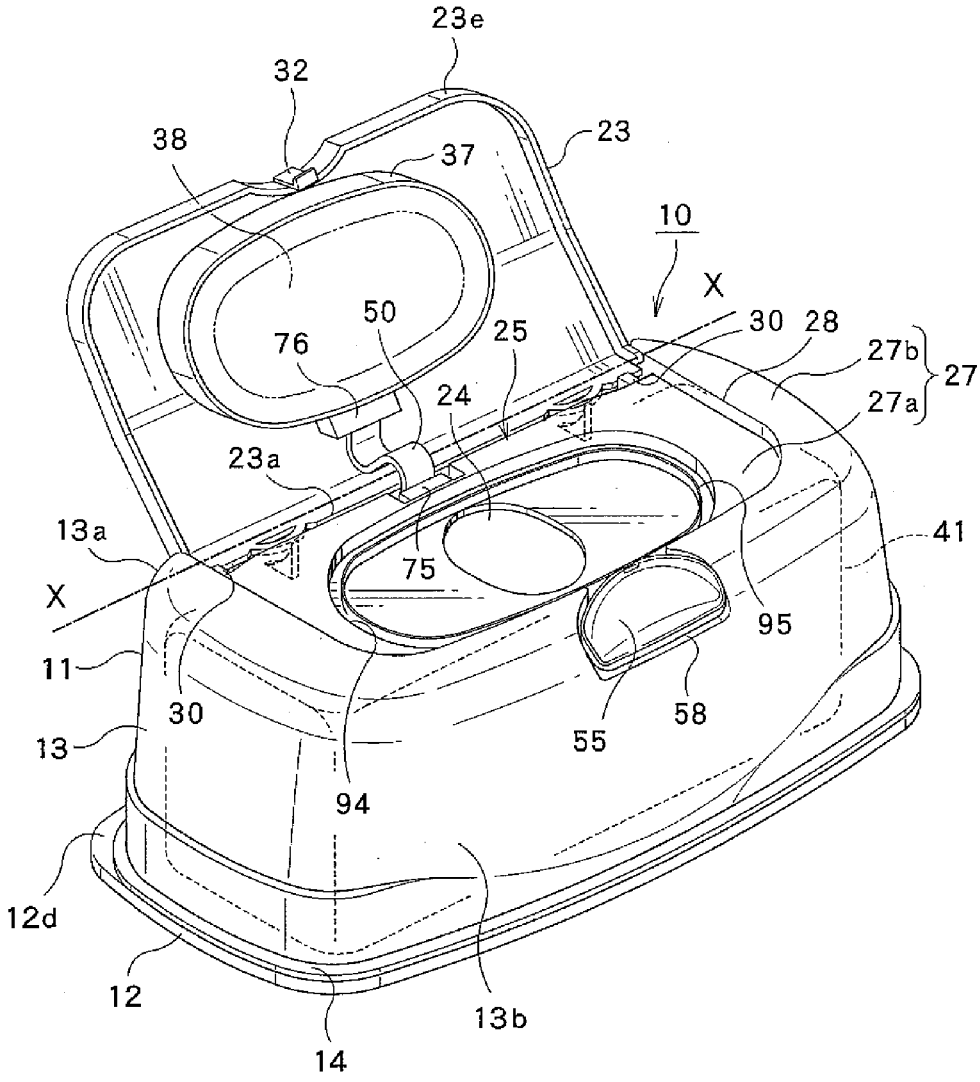
FIG. 1 is a perspective view of an openable and closable container according to an embodiment of the present invention.
Figure 2:
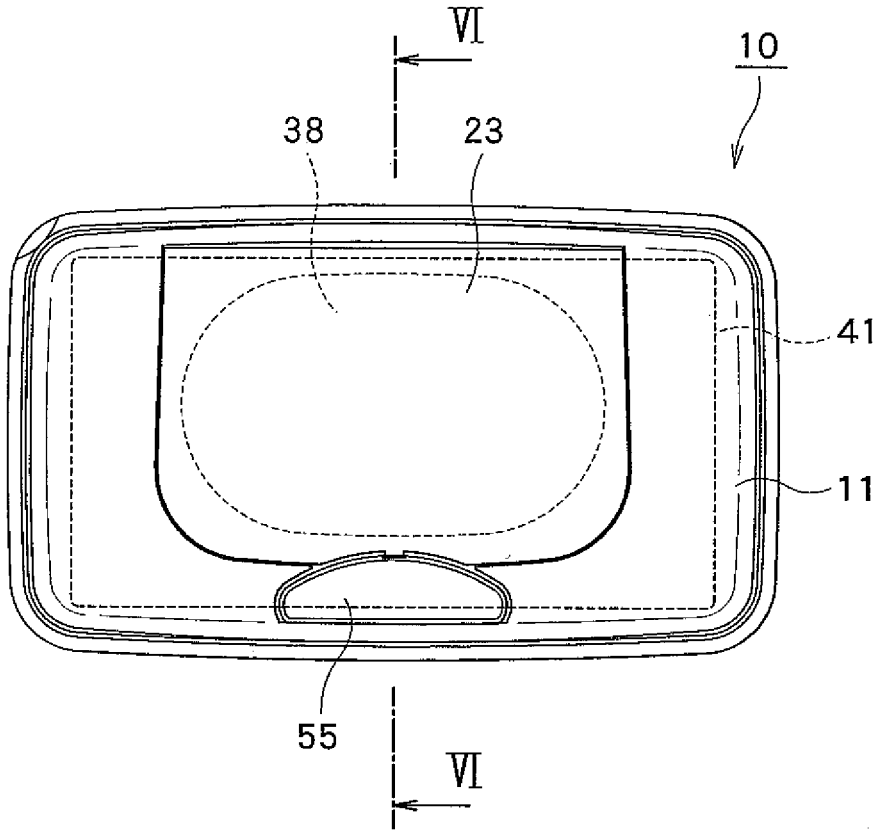
FIG. 2 is a plan view of the openable and closable container according to the embodiment of the present invention.
Figure 3:
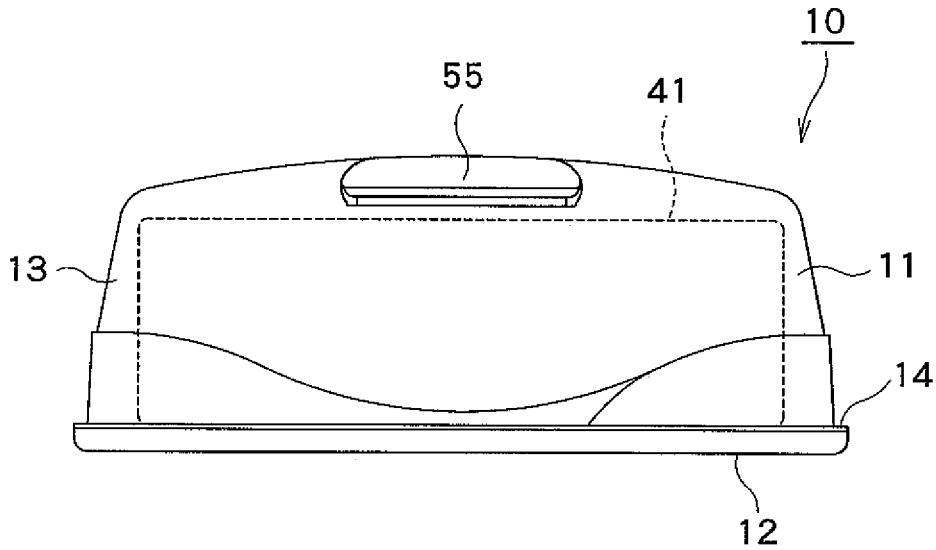
FIG. 3 is a front view of the openable and closable container according to the embodiment of the present invention.
Figure 4:
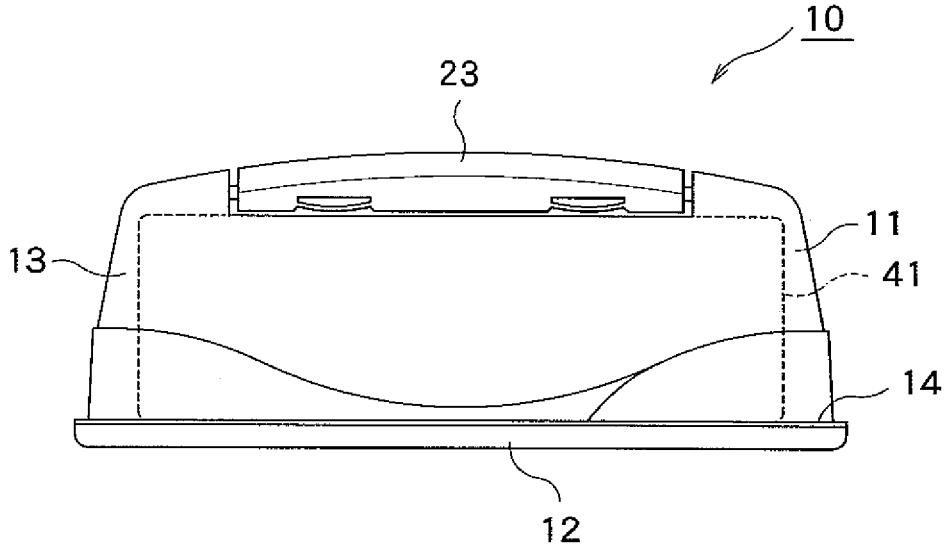
FIG. 4 is a rear view of the openable and closable container according to the embodiment of the present invention.
Figure 5:
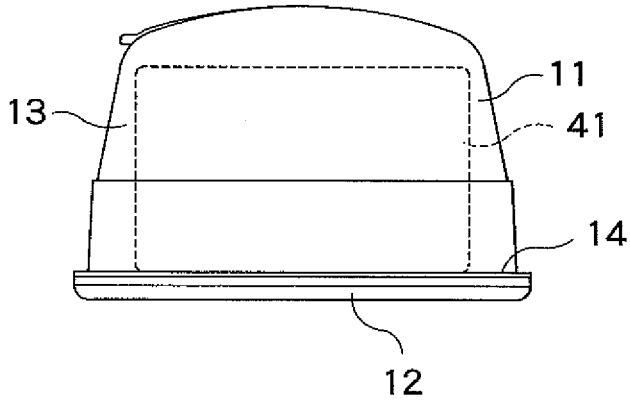
FIG. 5 is a lateral view of the openable and closable container according to the embodiment of the present invention.

As illustrated in FIG. 1, the container body 11 includes an upper plate 27 formed with a take-out opening 24 used to take out wet tissue paper 41, and a lateral plate 13 extending downward from the upper plate 27. An opening-closing lid 23 sealing the take-out opening 24 of the upper plate 27 is attached to the lateral plate 13 of the container body 11 so as to be swingable about a swing axis X-X on a base end 23*a* side of the lid.

The container body 11 is formed, on the base end 23*a* side of the opening-closing lid 23, with a rear step portion 25 extending parallel to the swing axis X-X and denting inwardly. A stopper 30 is provided in the vicinity of each of both ends of the rear step portion 25 so as to project upwardly from the bottom surface of the rear step portion 25. The stopper portions 30 are adapted to stop the base end 23*a* of the opening-closing lid 23 when the opening-closing lid 23 comes into a fully opened state. The stopper 30 stops the opening-closing lid 23 biased by plate rubber 50 (described later) at a predetermined position.

Further, the lateral plate 13 is formed at its lower portion with an outwardly projecting flange 14 in contact with the bottom lid 12. Incidentally, the bottom lid 12 is provided with a finger-putting piece 12*d* which projects outwardly from the lateral plate 13 and on which a user's finger is put. A pair of opposite lateral plates 13*a*, 13*b* projects outwardly in an Rounded-shape.

The upper plate 27 of the container body 11 includes a first upper plate (a first thin plate) 27*a* and a second upper plate (a second thin plate) 27*b*. The first upper plate 27*a* is located at a generally central portion of the plate 27. The second upper plate 27*b* is provided on the outside of the first upper plate 27*a* via a central step portion 28 and located at a portion higher than the first upper plate 27*a*. The take-out opening 24 described above is provided in the first upper plate 27*a*.

The first upper plate 27*a* is formed with a recessed portion 94 in which an annular rib 95 is provided so as to surround the take-out opening 24. In short, the take-out opening 24 described above is disposed within the annular rib 95. The annular rib 95 has a tilted surface 95*a* on the outer circumference thereof (on the side opposite the take-out opening 24) (see FIG. 15). The opening-closing lid 23 is formed on the rear surface with a frame body 37. A packing member (an elastic sealing body) 38 is attached to the inside of the frame body 37. The frame 37 is set inside the recessed portion 94 and outside the annular rib 95 when the opening-closing lid 23 is closed.

As described above, the packing member 38 formed like a dome is attached to the inside of the frame body 37. The packing member 38 is formed separately from the opening-closing lid 23. The packing member 38 is made of an elastic, soft synthetic resin material such as low-density polyethylene (LDPE) and is removably fitted into the frame body 37.

Figure 6:
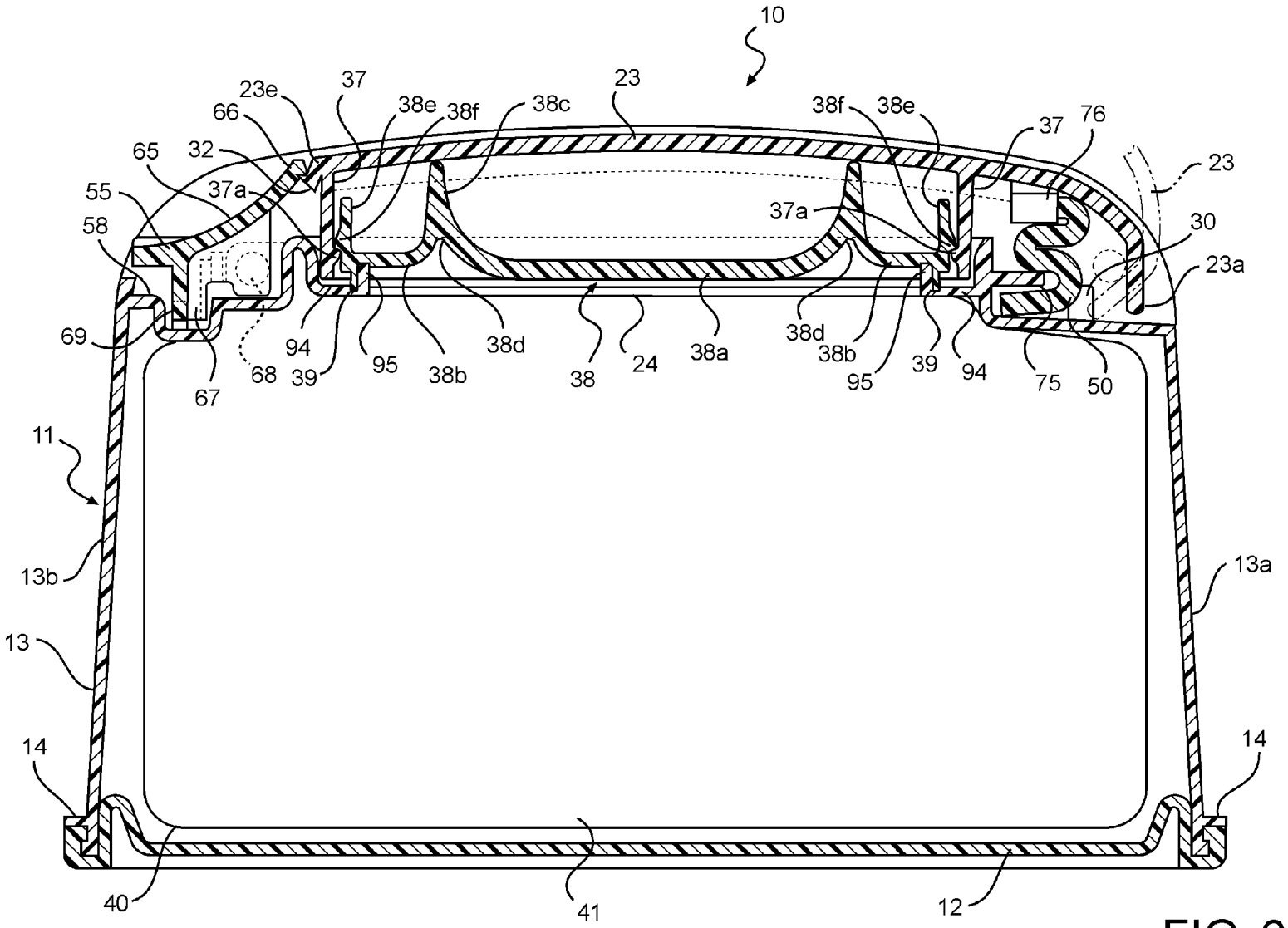
FIG. 6 is a vertical cross-sectional view of the openable and closable container according to the embodiment of the present invention (a cross-sectional view taken along line VI-VI in FIG. 2).
Figure 7:
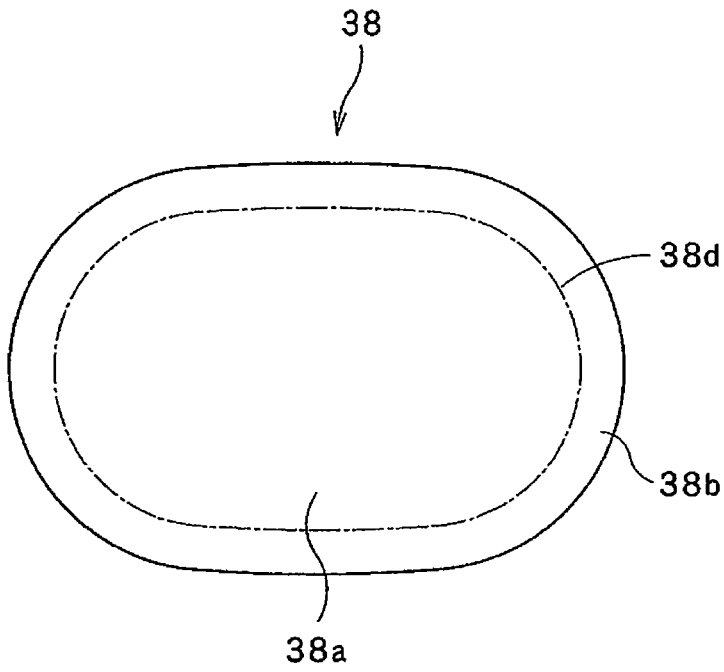
FIG. 7 is a bottom view of a packing member (an elastic sealing body) (a view as viewed from an arrow VII in FIG. 8).
Figure 8:
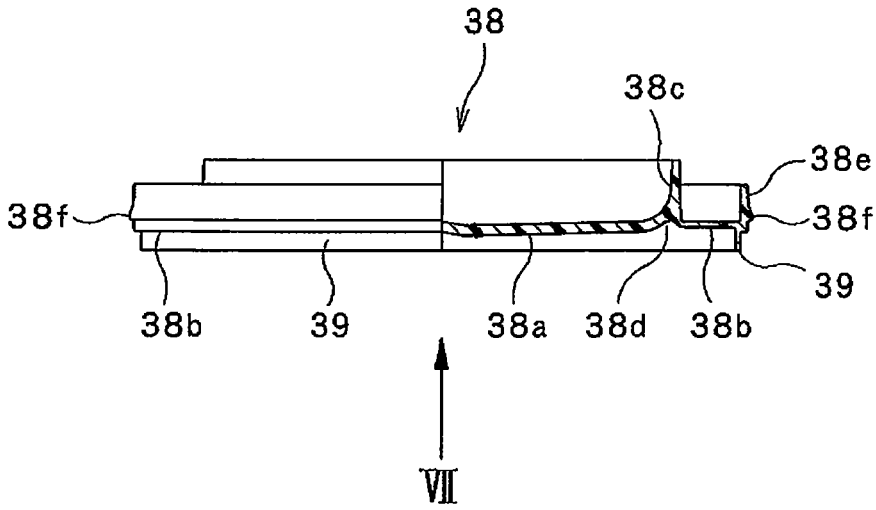
FIG. 8 is a partial cross-sectional view of the packing member (the elastic sealing body) as viewed from a front side.

Next, the configuration of the packing member 38 is further described with reference to FIGS. 6 to 8. As illustrated in FIGS. 6 to 8, the packing member 38 includes a packing central portion 38*a* and a packing outer circumferential portion 38*b*. The packing central portion 38*a* has a general oval shape in plan view. The packing outer circumferential portion 38*b* is provided on the outer circumference of the packing central portion 38*a* and can elastically move vertically with respect to the packing central portion 38*a*.

An inside rib 38*c* is formed between the packing central portion 38*a* and the packing outer circumferential portion 38*b*. The inside rib 38*c* extends vertically and has an upper end that comes into contact with the rear surface of the opening-closing lid 23 (see FIG. 6). On the other hand, an annular recessed portion 38*d* having an annular shape in plan view is formed on a lower end side of the inside rib 38*c*.

An outside rib 38*e* is formed along the outer circumference of the packing outer circumferential portion 38*b*. The outside rib 38*e* extends vertically upwardly from the packing outer circumferential portion 38*b*. In addition, the outside rib 38*e* has an upper end away from the rear surface of the opening-closing lid 23 (see FIG. 6). The outside rib 38*e* is provided with a first engaging projection 38*f* on the outer circumferential surface thereof. The first engaging projection 38*f* is engaged with a second engaging projection 37*a* provided on the inner circumferential surface of the frame body 37. In this way, the packing member 38 is removably fitted into the frame body 37.

On the other hand, a downside rib (a close-contact portion) 39 is provided at the lower portion of the packing outer circumferential portion 38*b*. The downside rib 39 extends downwardly from the packing outer circumferential portion 38*b* and has an annular shape as viewed from the bottom side. In this way, the downside rib 39 adheres with the circumference of the take-out opening 24 of the container body 11 when the opening-closing lid 23 is closed. Specifically, the downside rib 39 adheres to an annular rib 95 formed to surround the take-out opening 24 of the first upper plate (the first thin plate) 27*a*.

Referring to FIGS. 1 and 6, a free end 23*e* of the opening-closing lid 23 is provided with a retaining piece 32. The container body 11 is formed with a denting step portion 58 denting from the upper plate 27 is formed, on the free end 23*e* side of the opening-closing lid 23 and in the vicinity of the upper end of the lateral plate 13. An operating body (an operation button) 55 is provided in the denting step portion 58.

Figure 9:
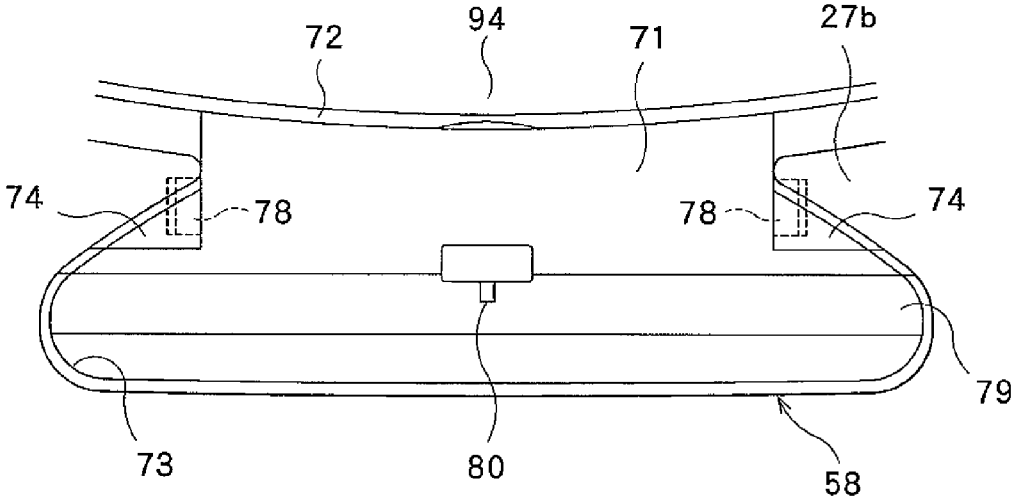
FIG. 9 is an enlarged view of a denting step portion.
Figure 10:
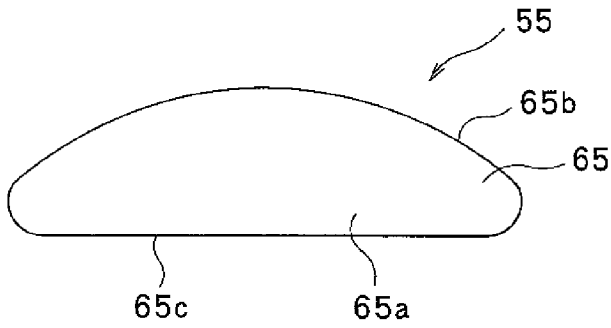
FIG. 10 is a plan view of an operating body (an operation button).

The operation button 55 is next described. The operation button 55 is attached to the denting step portion 58 of the container body 11. FIG. 9 is an enlarged plan view illustrating an attachment portion included in the container body 11 for attaching the operation button 55. FIGS. 10 to 13 illustrate details of the operation button 55.

Figure 11:
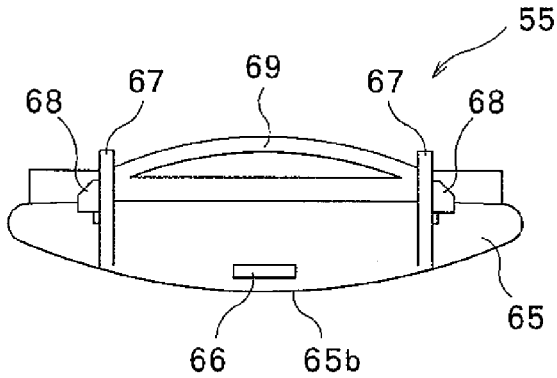
FIG. 11 is a bottom view of the operating body (the operation button).
Figure 12:
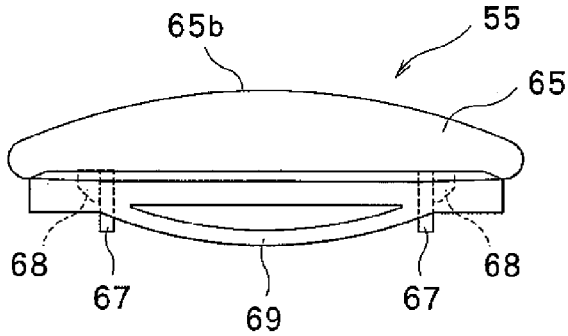
FIG. 12 is a front view of the operating body (the operation button).
Figure 13:
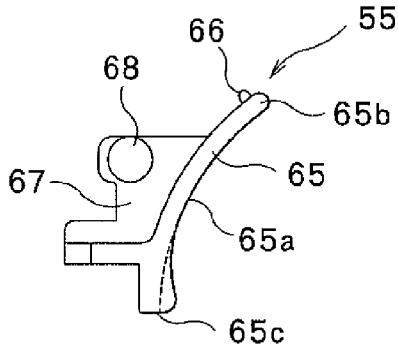
FIG. 13 is a lateral view of the operating body (the operation button).

Referring to FIGS. 10 to 13, the operation button 55 has a top plate portion 65. The top plate portion 65 is formed with an operation surface 65*a* on which a user's finger is put. The operation surface 65*a* is formed to draw a centrally dented curve. An outer circumference 65*b*, on a rear end side (on the upper side in FIG. 10) of the top plate portion 65 is curved arcuately. An outer circumference 65*c*, on a front end side, of the top plate portion 65 is formed linearly. As illustrated in FIGS. 11 and 13, the top plate portion 65 is formed, at the center of the rear end portion, with a claw portion 66 which comes into engagement with the retaining piece 32 of the opening-closing lid 23.

A pair of attachment ribs 67, 67 is provided to project from the rear surface of the top plate portion 65. The attachment ribs 67, 67 are formed with respective hinge shafts 68, 68, which are coaxial with each other. Further, an arcuate spring portion 69 is formed on the front end side of the rear surface of the top plate portion 65.

As illustrated in FIG. 9, the denting step portion 58 of the container body 11 is surrounded by a bottom plate 71, a lateral plate 72 disposed between the bottom plate 71 and the recessed portion 94, and a lateral plate 73 disposed between the bottom plate 71 and the second upper plate 27*b*. A pair of step portions 74, 74 projecting inward is formed in the vicinity of both corresponding ends of the lateral plate 73. The step portions 74, 74 are formed with respective hinge-receiving holes 78, 78 adapted to receive the corresponding hinge shafts 68, 68 of the operation button 55. The bottom plate 71 is provided with a spring-receiving groove 79 adapted to receive the spring portion 69 of the operation button 55. A rib 80 is provided in the spring-receiving groove 79 in order to hold the center of the spring portion 69 at a predetermined position in a vertical direction.

The spring portion 69 of the operation button 55 is fitted to the spring-receiving groove 79 and the hinge shaft 68 is fitted to each of the hinge-receiving holes 78, 78. Thus, the operation button 55 is attached to the inside of the denting step portion 58 turnably around the hinge shaft 68. The claw portion 66 of the operation button 55 is biased, by the resilience of the spring portion 69, around the hinge shaft 68 in a direction (downward in FIG. 6) in which the claw portion 66 approaches the recessed portion 94.

When the opening-closing lid 23 is closed, the operation button 55 turns in such a manner as to yield to the retaining piece 32 of the opening-closing lid 23. When the retaining piece 32 overrides the claw portion 66, the operation button 55 turns based on the force exerted by the spring portion 69. As a result, the retaining piece 32 and the claw portion 66 come into engagement with each other to keep the opening-closing lid 23 in the closed state.

In contrast, if a user depresses the operation surface 65*a* of the operation button 55 with the opening-closing lid 23 closed, the claw portion 66 of the operation button 55 turns about the hinge shaft 68 in a direction in which it is spaced apart from the recessed portion 94. As a result, the retaining piece 32 is disengaged with the claw portion 66.

Incidentally, as illustrated in FIGS. 1 and 6, elongated plate rubber (an elastic member) 50 biasing the opening-closing lid 23 in the opening direction is provided between the container body 11 and the opening-closing lid 23. Specifically, the container body 11 is provided with a housing portion 75 horizontally and insertably housing one end of the plate rubber 50 and the opening-closing lid 23 is provided with a securing portion 76 horizontally securing the other end of the plate rubber 50.

Incidentally, the container body 11 and the opening-closing lid 23 described above are each obtained by injection molding by use of polypropylene (PP). However, they may be molded by use of another material, such as PE, PS, ABS, elastomer, PET, PVC, or polycarbonate. The bottom lid 12 preferably uses linear low-density polyethylene (LLDPE). Further, the plate rubber 50 uses silicon rubber. The securing portion 76 is made of polypropylene.

Figure 14:
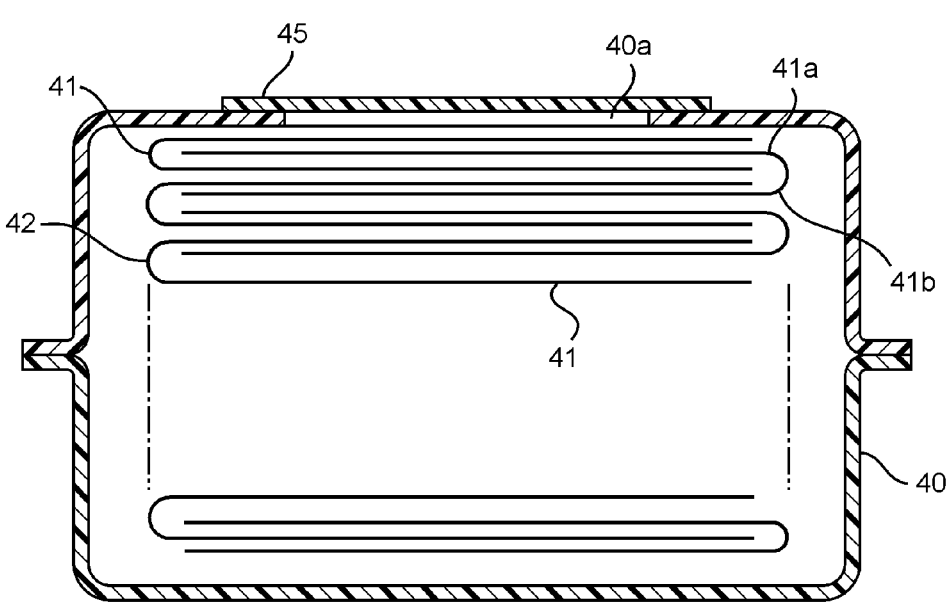
FIGS. 14(*a*) and (*b*) are lateral cross-sectional views of a sealed bag storing wet tissue paper.
Figure 14:
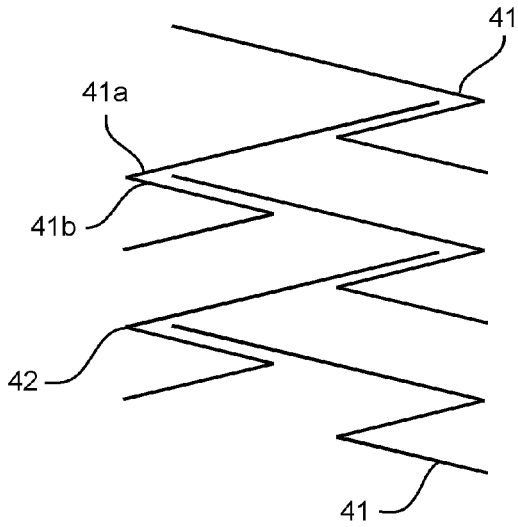

The wet tissue paper 41 stored in the container body 11 is next described with reference to FIGS. 14(*a*) and (*b*). As illustrated in FIG. 14(*a*), the wet tissue papers 41 folded back, i.e., are located in a stacked manner in a sealed bag 40 made of a soft sheet and are sealed within the sealed bag 40. Each piece of the wet tissue paper 41 is generally doubled up to form a folded portion 42. Each of the folded portions 42 of the wet tissue papers 41 are alternately changed in direction. A lower half portion 41*b* of a wet tissue paper 41 doubled up is inserted between an upper portion 41*a* of a wet tissue paper 41 located on the lower side and an upper half portion 41*a* of a wet tissue paper 41 located on a further lower side. Therefore, when the wet tissue paper 41 is pinched and taken out one by one, the lower half portion 41*b* of a wet tissue paper 41 taken out will pull up the upper portion 41*a* of a wet tissue paper 41 located on the lower side. Incidentally, how to fold the wet tissue paper 41 needs only to dispose the wet tissue paper 41 in a stacked manner so that the wet tissue paper 41 may continuously be taken out. However, how to fold the wet tissue paper 41 is not particularly restrictive. For example, also a folding method as illustrated in FIG. 14(*b*) may be available. The sealed bag 40 is provided with an opening 40*a* on the upper end thereof. The opening 40*a* is sealed by a lid piece 45 removably attached to the upper surface of the sealed bag 40.

Material of the wet tissue paper 41 used includes a fiber material such as nonwoven fabric, paper, and gauze, a sheet-like foam, or a paper-based soft material. Conceivable examples of liquid impregnated into the wet tissue paper 41 include cosmetics such as a wetting agent containing a bactericidal agent, disinfectant, a cleaning agent, etc., lotion, and skin milk. The present embodiment enhances the sealing performance of the container body 11 with the opening-closing lid 23. Therefore, wet tissue paper 41 impregnated with, especially, alcohol or other highly volatile liquid can preferably be used.

A description is next given of the operation of the present embodiment configured as described above.

When a wet tissue paper 41 is taken out for use, a user first depresses the top plate portion 65 of the operation button 55. This releases the engagement between the retaining piece 32 and the claw portion 66. In this case, the resilience of the plate rubber 50 opens the opening-closing lid 23.

Specifically, the opening-closing lid 23 is biased by the plate rubber 50 and turned about the swing axis X-X in the opening direction (in the clockwise direction in FIG. 6). Thereafter, when the opening-closing lid 23 reaches the fully opened position, the base end 23*a* of the opening-closing lid 23 is retained by the stopper 30 to stop the opening-closing lid 23.

The wet tissue paper 41 is next pinched with user's fingers and pulled out upward from the take-out opening 24 of the container body 11 for use.

In this way, the wet tissue paper 41 is taken out and thereafter the opening-closing lid 23 is closed. In this case, a user depresses the opening-closing lid 23 downward with her or his hand. This turns the opening-closing lid 23 about the swing axis X-X in the closing direction (the counterclockwise direction in FIG. 6) against the biasing force of the plate rubber 50. Thereafter, when the opening-closing lid 23 reaches the fully closed position, the retaining piece 32 of the opening-closing lid 23 comes into engagement with the claw portion 66 of the operating body (the operation button) 55 to secure the opening-closing lid 23 at the fully closed position.

Figure 15:
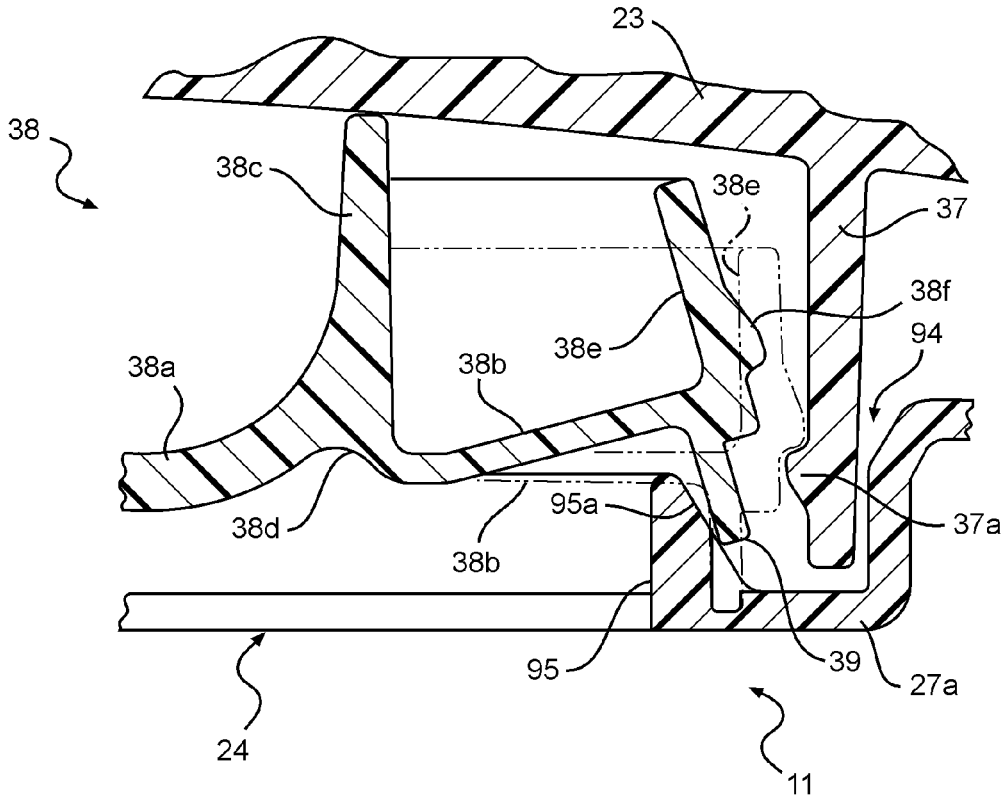
FIG. 15 is a partial enlarged cross-sectional view illustrating the operation of the packing member (the elastic sealing body).

In this period, as illustrated in FIG. 15, the downside rib 39 of the packing member 38 is raised along the tilted surface 95*a* of the annular rib 95. That is to say, as described above, the packing member 38 is made of an elastic material and the packing outer circumferential portion 38*b* and the downside rib 39 are vertically and elastically movable in an integrated manner. Therefore, when the opening-closing lid 23 is closed, the underside rib 39 is raised along the tilted surface 95*a* of the annular rib 95. In this case, the underside rib 39 is pressed against the tilted surface 95*a* due to the resilience of the packing outer circumferential portion 38*b*, so that the underside rib 39 and the tilted surface 95*a* come into close contact with each other. In this way, the take-out opening 24 of the container body 11 is sealed by the packing member 38.

According to the present embodiment described above, the packing member (the elastic sealing body) 38 is attached to the rear surface of the opening-closing lid 23. In addition, the take-out opening 24 of the container body 11 is sealed by the packing member 38. The packing member 38 includes the packing central portion 38*a* and the packing outer circumferential portion 38*b* provided on the outer circumference of the packing central portion 38*a* so as to be movable vertically and elastically. Further, the packing outer circumferential portion 38*b* is provided with the downside rib (the close-contact portion) 39. When the opening-closing rid 23 is closed, the downside rib 39 comes into close contact with the annular rib 95. In this way, the sealing performance of the container body 11 with the opening-closing lid 23 can be enhanced, so that the liquid component in the wet tissue paper 41 can be prevented from vaporizing through the take-out opening 24.

Incidentally, in the present embodiment, the openable and closable container 10 includes the container body (the main body) 11 having the take-out opening 24 and the opening-closing lid 23 adapted to open/close the take-out opening 24. However, the configuration of the openable and closable container is not limited to this. For example, the openable and closable container may include a container main body, a lid body (a main body) that is attached to the container body and has a take-out opening, and an opening-closing lid swingably provided on the lid body so as to open/close the take-out opening of the lid body.

The invention claimed is:

1. An openable and closable container comprising:

a main body having a take-out opening;

an opening-closing lid provided on the main body swingably about a swing axis on a base end side of the lid, the opening-closing lid opening and closing the take-out opening; and an elastic member provided between the main body and the opening-closing lid;

wherein an elastic sealing body is attached to a rear surface of the opening-closing lid such that the elastic sealing body seals the take-out opening of the main body, wherein a frame body is formed on a rear surface of the opening-closing lid, and the elastic sealing body is composed of a packing member attached to the inside of the frame body, wherein the packing member includes:

a packing central portion, a packing outer circumferential portion provided on an outer circumference of the packing central portion and elastically vertically movable with respect to the packing central portion, and a close-contact portion provided at a downward portion of the packing outer circumferential portion, and when the opening-closing lid is closed, the close-contact portion comes into close contact with a circumference of the take-out opening of the main body wherein an outside rib is formed along the outer circumference of the packing outer circumferential portion, the outside rib extends vertically upward from the packing outer circumferential portion, and the outside rib has an upper end away from the rear surface of the opening-closing lid, wherein an inside rib is formed between the packing central portion and the packing outer circumferential portion and extends vertically, and wherein the packing outer circumferential portion has a flat portion that is defined between lower portions of the inside rib and the outside rib.

2. The openable and closable container according to claim 1, wherein the main body includes an upper plate in which the take-out opening is formed.

3. The openable and closable container according to claim 1, wherein an annular rib is formed on an upper plate of the main body to surround the take-out opening, and when the opening-closing lid is closed, the close-contact portion comes into close contact with the annular rib.

4. The openable and closable container according to claim 1, wherein the main body is composed of a container body, and wet tissue paper impregnated with alcohol is stored inside of the container body.

* * * * *